US006269568B1

(12) United States Patent
Lo

(10) Patent No.: US 6,269,568 B1
(45) Date of Patent: Aug. 7, 2001

(54) DECORATION WITH A VARIABLE BILLBOARD

(75) Inventor: Szu Wei Lo, Nan-Tou Hsien (TW)

(73) Assignee: Single-Tree Art Industry Co., Ltd., Taichung (TW)

( * ) Notice: Subject to any disclaimer, the term of this patent is extended or adjusted under 35 U.S.C. 154(b) by 0 days.

(21) Appl. No.: 09/329,281

(22) Filed: Jun. 10, 1999

(51) Int. Cl.[7] ..... G09F 11/02

(52) U.S. Cl. ..... 40/504; 40/503; 74/84 R; 74/125.5

(58) Field of Search ..... 40/503–507; 74/84 R, 74/112, 125.5

(56) References Cited

U.S. PATENT DOCUMENTS 1,718,625 * 6/1929 Bartoletti ..... 40/504

1,785,204 * 1/1930 Nelson ..... 40/505

* cited by examiner

*Primary Examiner*—Cassandra H. Davis
(74) *Attorney, Agent, or Firm*—Rosenberg, Klein & Lee

(57) ABSTRACT

A decoration with a variable billboard including a decorative hollow base seat in which an energy reserving device is disposed. The energy reserving device includes a coil spring and a handle disposed at the center of the coil spring. The handle extends out of the base seat. A billboard is disposed on a top face of the base seat. Multiple parallel triangular columns are rotatably disposed in a frame of the billboard. A mandrel of each triangular column extends into the base seat. A driven gear is disposed at a bottom end of the mandrel. Each face of the triangular column is printed with a predetermined picture. The coil spring drives an intermittently rotating mechanism to operate and make a click drive a ratchet to intermittently rotate through 120 degrees. The ratchet is coaxially disposed with a driving gear for driving a driven gear of the billboard, so that the multiple triangular columns of the billboard are synchronously driven to intermittently rotate face by face so as to variably present three kinds of predetermined pictures printed on the billboard.

11 Claims, 7 Drawing Sheets

DECORATION WITH A VARIABLE BILLBOARD

BACKGROUND OF THE INVENTION

The present invention relates to a decoration with a variable billboard, and more particularly to a decoration in which a billboard printed with variable pictures is driven a manually operated coil spring so as to intermittently variably present the pictures.

FIG. 7 shows an existing house decoration the surface of which is printed with an advertisement or promotion picture. Such decoration is monotonous and lacks competitive advertisement function.

SUMMARY OF THE INVENTION

It is a primary object of the present invention to provide a decoration with a variable billboard, in which the billboard includes multiple triangular columns each face of which is printed with a predetermined pictures. A coil spring is used to drive an intermittently rotating mechanism for pushing the triangular columns to intermittently rotate so as to variably present the pictures of the billboard and increase the entertaining effect of the billboard.

According to the above object, the decoration of the present invention includes:

a decorative hollow base seat formed with a specific aspect;

an energy reserving device disposed in the base seat;

a billboard disposed on a top face of the base seat, the billboard having a frame in which multiple parallel upright triangular columns are rotatably disposed, a mandrel of each triangular column extending into the base seat, a driven gear being disposed at a bottom end of the mandrel, each face of the triangular column being printed with a predetermined picture; and an intermittently rotating mechanism disposed in the base seat, the energy reserving device serving as a power source for driving the intermittently rotating mechanism to operate and make a click drive a ratchet to intermittently rotate through 120 degrees, the ratchet being coaxially disposed with a driving gear for driving a driven gear of the billboard, whereby the multiple triangular columns of the billboard are synchronously driven to intermittently rotate so as to variably present the pictures of the billboard.

The present invention can be best understood through the following description and accompanying drawings wherein:

DETAILED DESCRIPTION OF THE PREFERRED EMBODIMENTS

Figure 1:
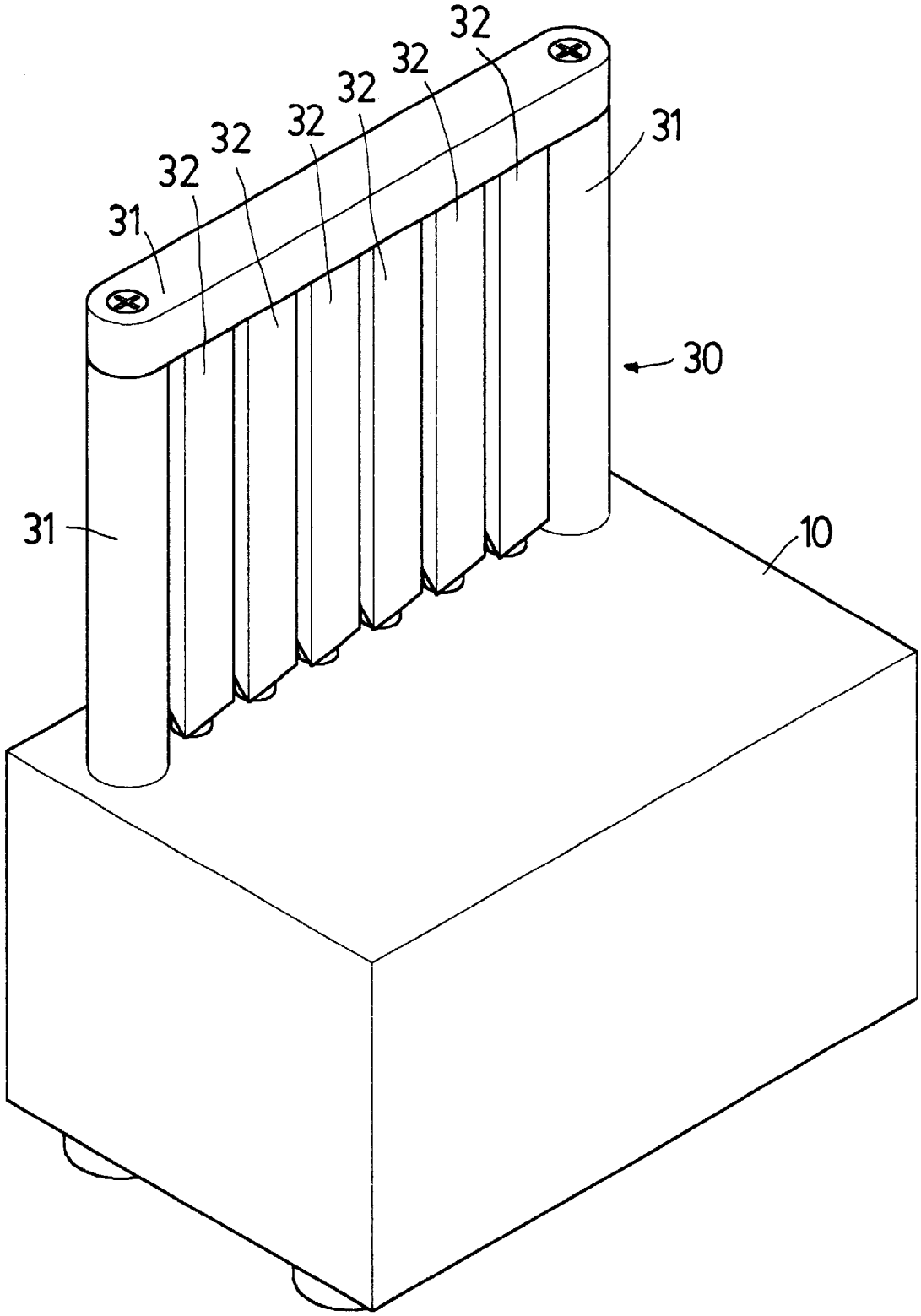
FIG. 1 is a perspective view showing the appearance of the decoration of the present invention.
Figure 2:
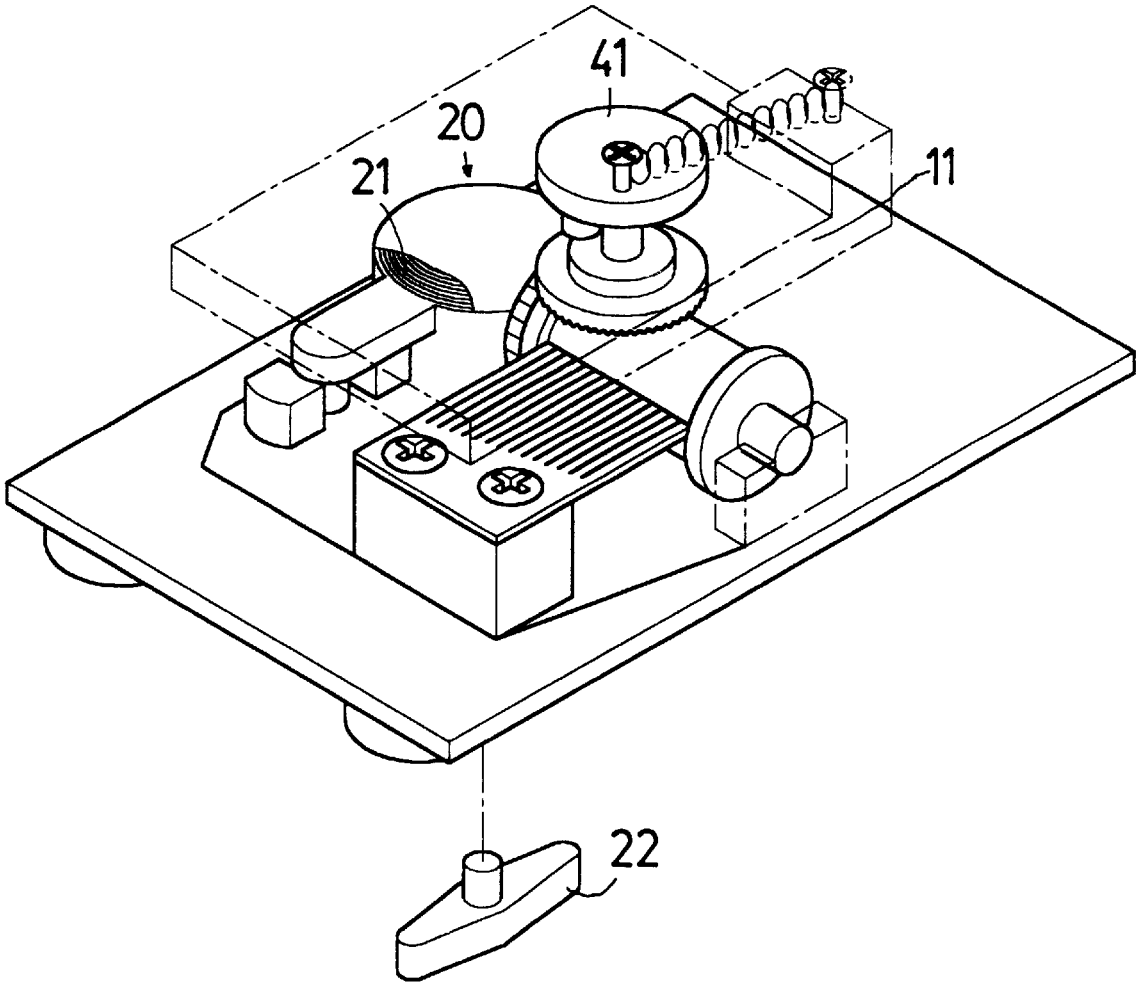
FIG. 2 is a perspective view showing that the energy reserving device drives the intermittently rotating mechanism of the present invention.
Figure 3:
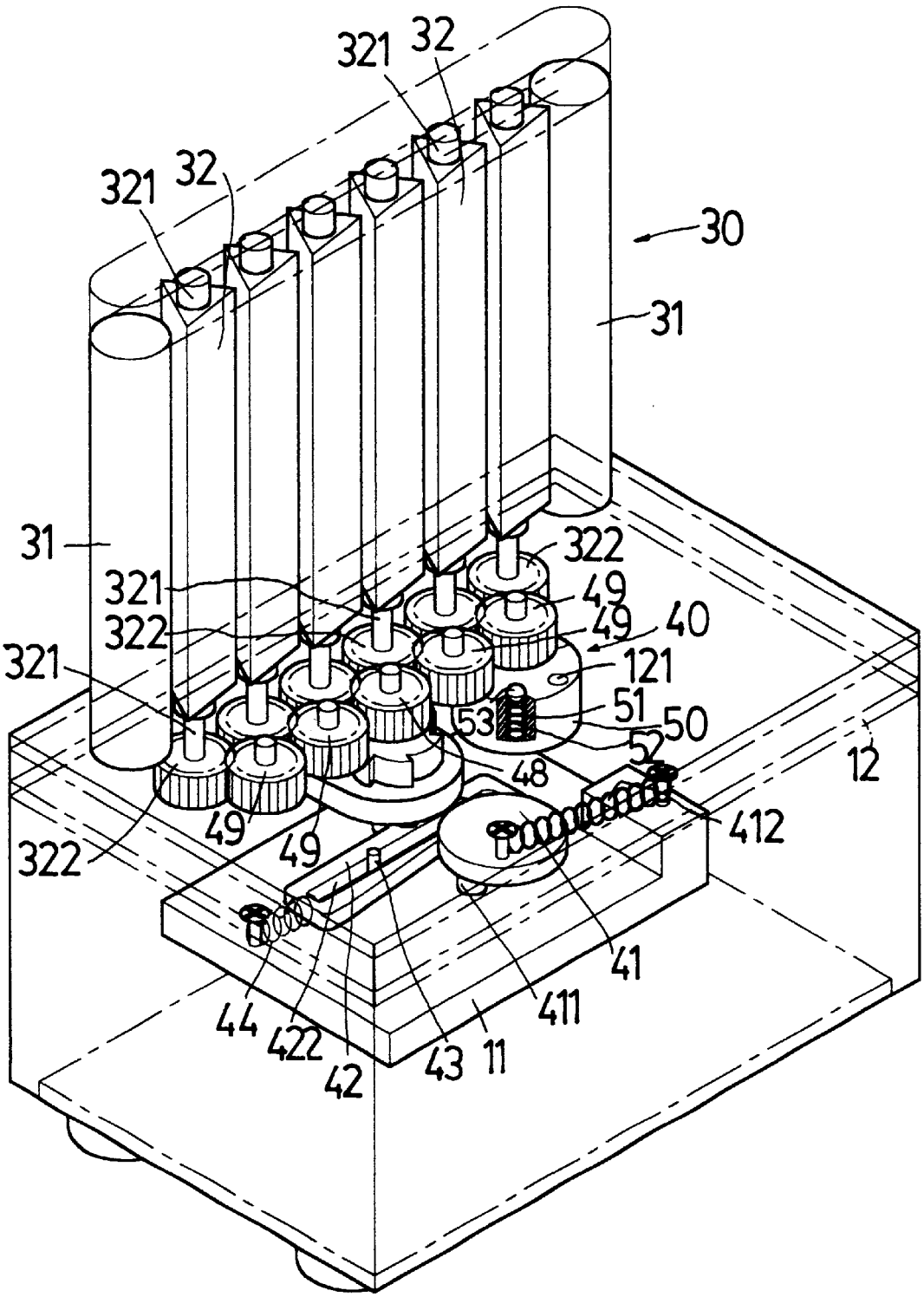
FIG. 3 is a perspective view showing the structure of the billboard and the intermittently rotating mechanism of the present invention.
Figure 4:
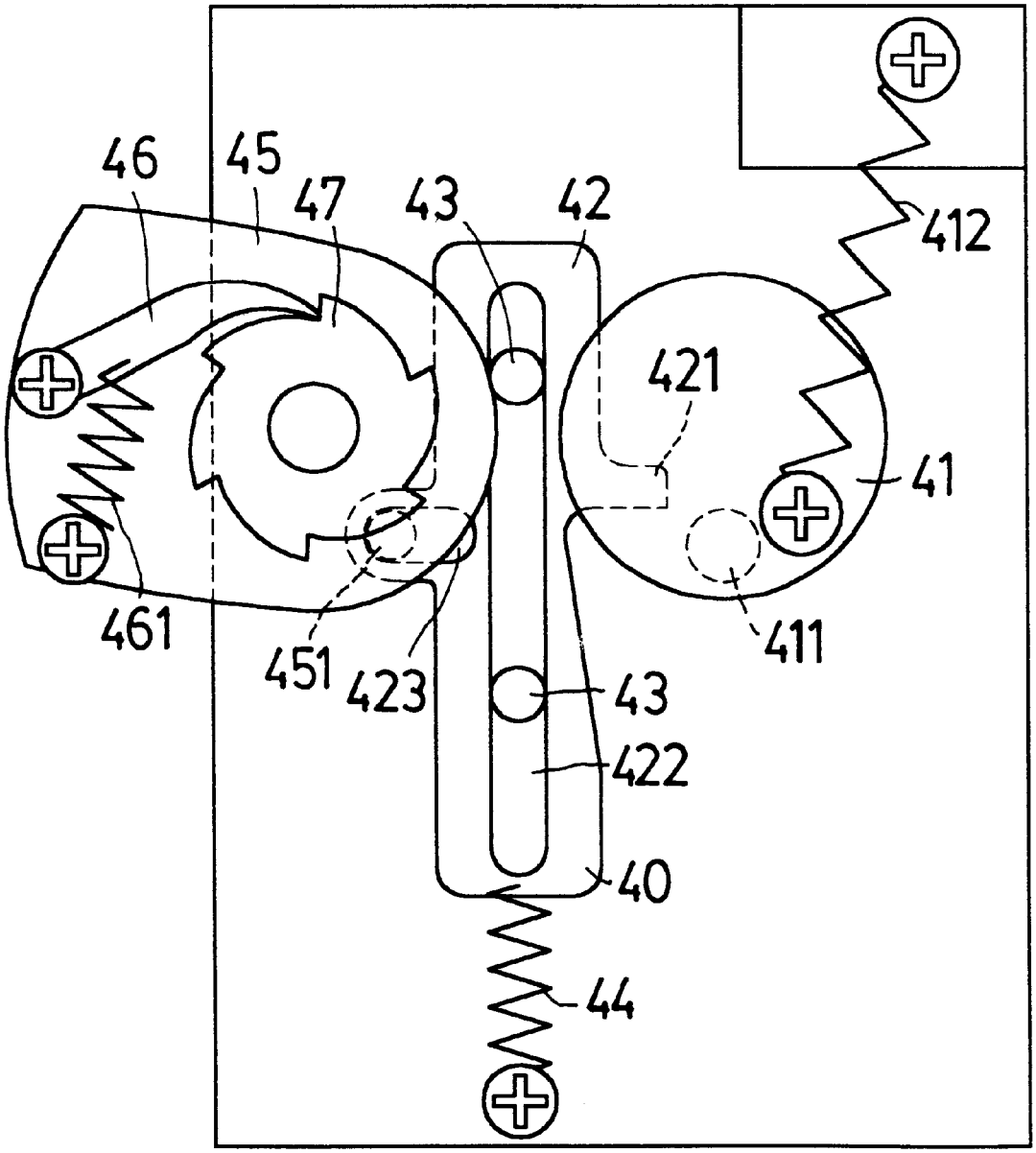
FIG. 4 shows the rotation of the intermittently rotating mechanism of the present invention in one state.
Figure 5:
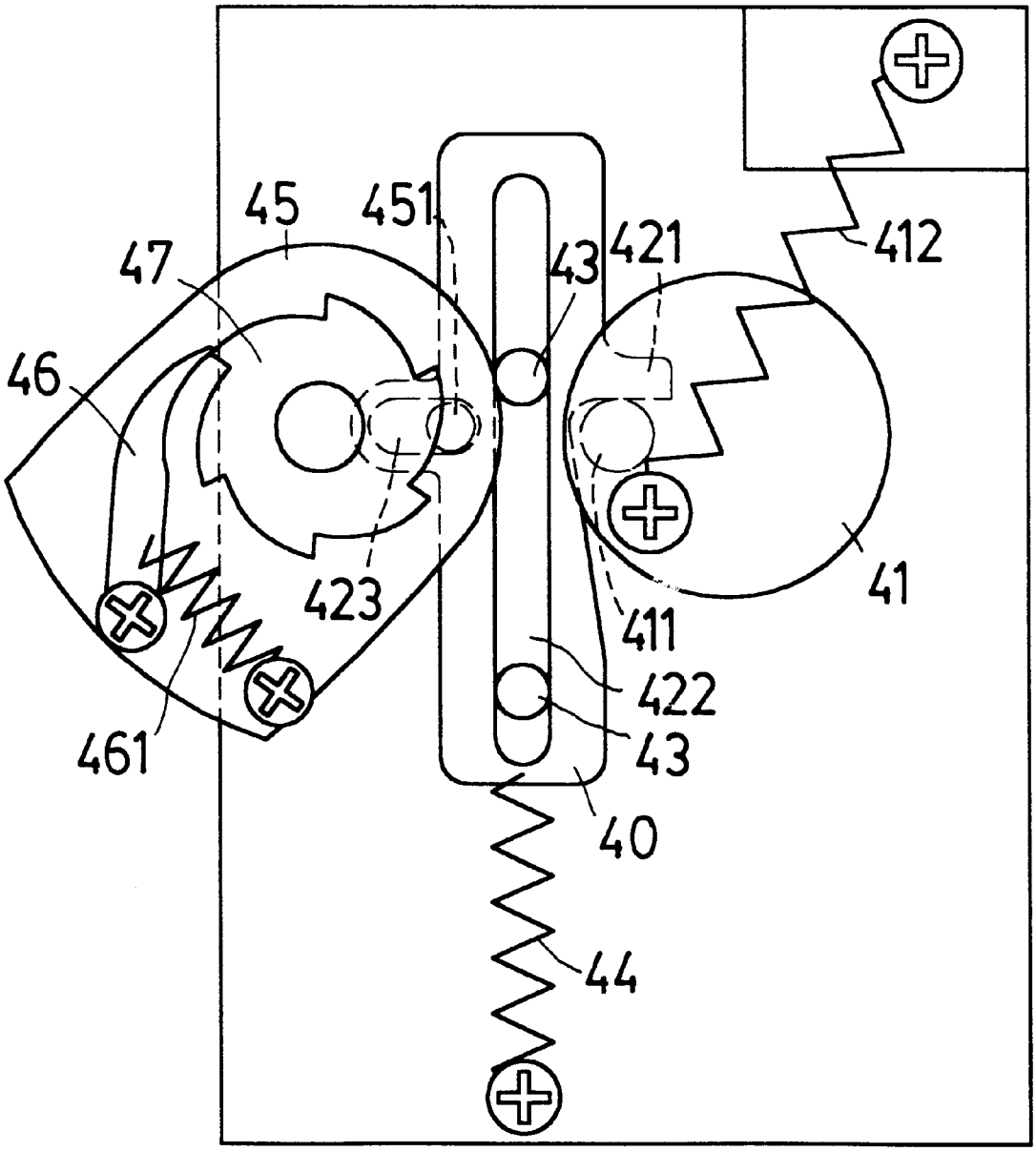
FIG. 5 shows the rotation of the intermittently rotating mechanism of the present invention in another state.
Figure 6:
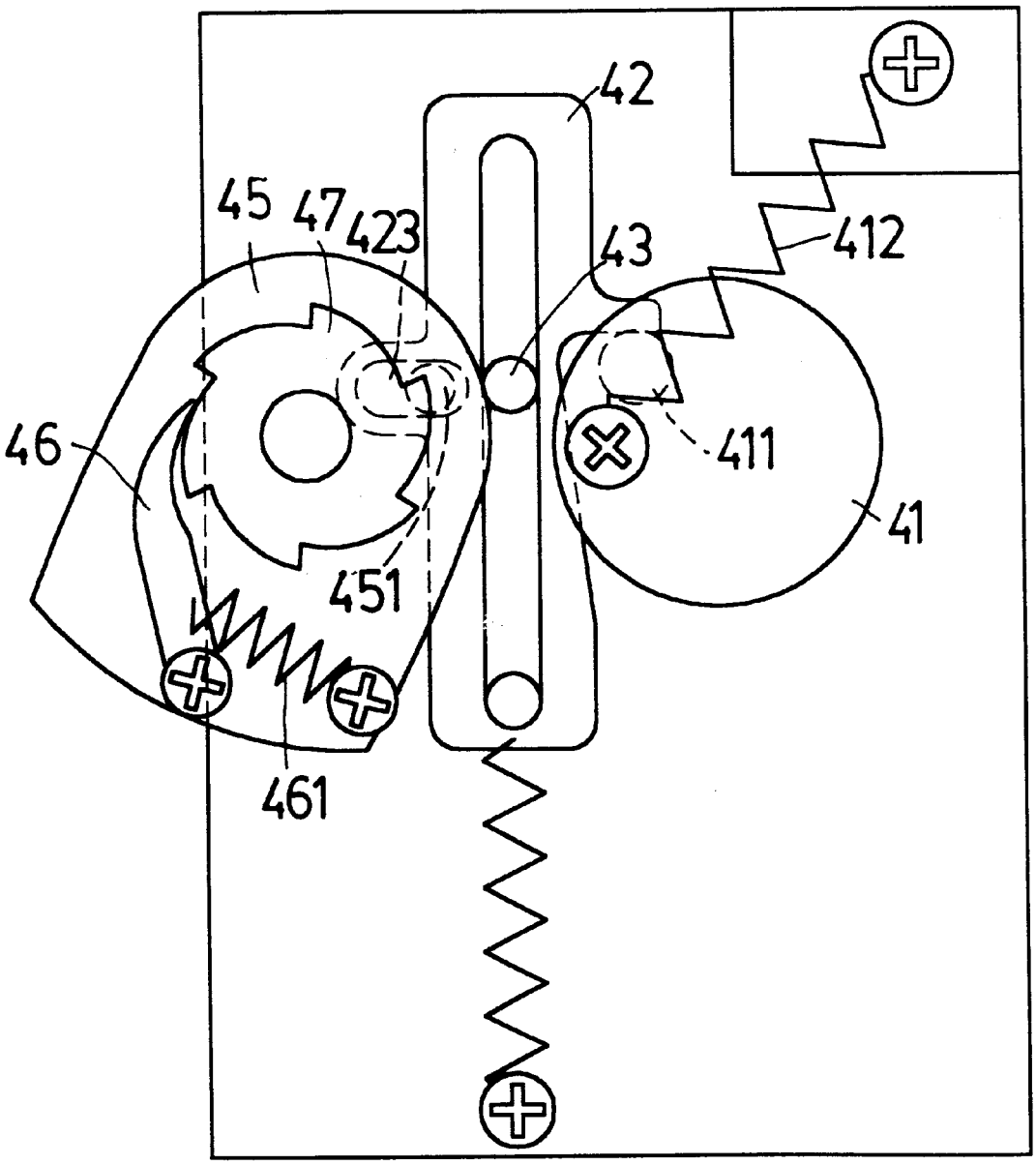
FIG. 6 shows the rotation of the intermittently rotating mechanism of the present invention in still another state.
Figure 7:
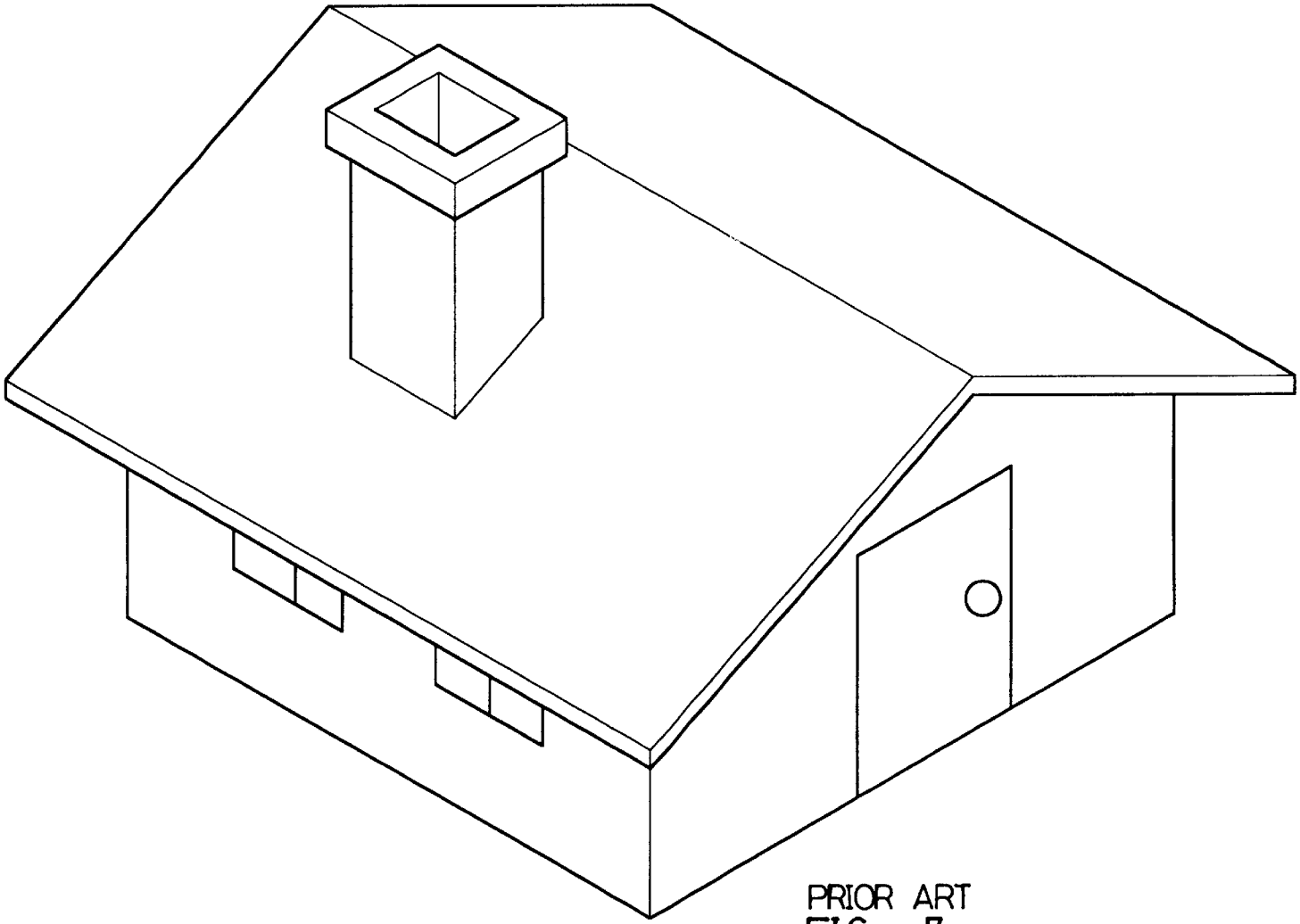
PRIOR ART FIG. 7
FIG. 7 shows an existing house decoration.

Please refer to FIGS. 1 and 4. The decoration of the present invention includes:

a decorative hollow base seat 10 formed with a specific aspect such as a house, a jewelry box, an art decoration, etc.;

an energy reserving device 20 disposed in the base seat 10, in this embodiment, the energy reserving device 20 being a music bell employing a coil spring 21 as power source, a handle 22 being disposed at the center of the coil spring 21, the handle 22 protruding out from the bottom side of the base seat 10, whereby by means of rotating the handle 22, the coil spring 21 is able to reserve energy for driving the music bell to operate;

a billboard 30 disposed on the top face of the base seat 10, the billboard 30 having a frame 31 in which multiple parallel triangular columns 32 are rotatably disposed, the bottom end of a mandrel 321 of each triangular column 32 extending into the base seat 10, a driven gear 322 being disposed at the bottom end of the mandrel 321, each face of the triangular column 32 being printed with a predetermined picture; and an intermittently rotating mechanism 40 disposed on a first base board 11 in the base seat 10, the coil spring 21 of the energy reserving device 20 serving as a power source which via a gear set of the music bell rotarily drives a first rotary tray 41 of the intermittently rotating mechanism 40, the bottom face of the first rotary tray 41 being disposed with a short rod 411, when the first rotary tray 41 rotates, the short rod 411 pushing a projection 421 of a slide board 42, one end of a spring 412 being fixed on the top face of the first rotary tray 41 by a fixing member, a bolt being passed through the other end of the spring 412 to fix the end on the first base board 11, when the short rod 411 of the first rotary tray 41 pushes the projection 421 of the slide board 42, the spring 412 serving to provide an auxiliary pushing force.

The slide board 42 is formed with a central slot 422 in which two pins 43 of the first base board 11 are fitted. When the short rod 411 of the first rotary tray 41 pushes the projection 421, the slide board 42 is slided and restricted by the pins 43 fitted in the slot 422. One end of the slide board 42 is connected with an extension spring 44 fixed on the first base board 11 by a bolt. After the slide board 42 is pushed by the short rod 411 to slide, the extension spring 44 serves to resiliently pull and restore the slide board 42 back to its home position. The other side of the slide board 42 opposite to the projection 421 is formed with an elliptic hole 423 in which a projecting rod 451 disposed on the bottom face of a second rotary tray 45 is fitted.

A click 46 and a ratchet 47 are pivotally disposed on the top face of the second rotary tray 45. A middle section of the click 46 is connected with a spring 461 which keeps the click 46 in contact with the ratchet 47. A bolt is passed through the other end of the spring 461 to fix the end on the second rotary tray 45. The wall of the elliptic hole 423 of the slide board 42 pushes the projecting rod 451 so as to reciprocally rotate the second rotary tray 45. The ratchet 47 is coaxially disposed with a driving gear 48 extending to the top face of a second base board 12. The driving gear 48 is engaged between the driven gears 322 of two adjacent triangular columns 32. An idle gear 49 is engaged between each two adjacent driven gears 322. When the driving gear 48 is rotated, each triangular column 32 is synchronously rotated in the same direction by the same angle.

The idle gear 49 on the second base board 12 is coaxially disposed with a locating block 50 extending to the bottom face of the second base board 12. The top face of the locating block 50 is formed with a cavity 51 in which a spring 52 is disposed. A steel ball 53 is connected with a top end of the spring 52. The bottom face of the second base board 12 is formed with three dents 121 about the idle gear 49 at equal intervals. The steel ball 53 of the locating block 50 can be pushed by the spring 52 to engage and locate in the dent 121. Accordingly, the triangular column 32 of the billboard 30 can be accurately located after rotating through each 120 degrees. Therefore, the triangular columns 32 can be rotated to present a tidy picture.

According to the above arrangement, the present invention not only provide the function of a music bell, but also provides the function of a billboard. Three predetermined pictures are printed on the three faces of each triangular column 32 of the billboard 31. When the triangular columns 32 are driven by the intermittently driving mechanism 40, the triangular columns 32 are synchronously rotated in the same direction by the same angle, whereby the billboard 31 can intermittently present three kinds of pictures. The steel ball 53 of the locating block 50 can be engaged and located in the dent 121 of the second base board 12 so that the triangular columns 32 can be accurately located after rotating through each 120 degrees so as to achieve a tidy picture. Accordingly, the billboard 30 can provide an advertisement effect and increase the entertaining effect of the decoration.

The components of the present invention can be modified to achieve the same effect. For example, the energy reserving device 20 can be a motor powered by a cell instead of the coil spring 21.

The above embodiments are only used to illustrate the present invention, not intended to limit the scope thereof. Many modifications of the above embodiments can be made without departing from the spirit of the present invention.

What is claimed is:

1. A variable billboard apparatus comprising:

(a) a decorative housing having a substantially hollow base seat;

(b) a billboard assembly disposed on said base seat, said billboard assembly including a frame and a plurality of substantially parallel elongate columns pivotally coupled thereto, each said column having a triangular sectional contour defined by a plurality of indicia bearing faces, each said column having first and second mandrels extending from axially opposed ends thereof, said first mandrel pivotally engaging said frame, said second mandrel having a driven gear portion formed thereon;

(c) an intermittently rotating mechanism disposed in said base seat, said intermittently rotating mechanism including:

(1) a ratchet rotatable through at least approximately 120 degrees;

(2) a driving gear coaxially coupled to said ratchet, said driving gear engaging at least one said driven gear of said billboard assembly for pivoting at least one said column responsive to said ratchet rotation; and, (3) a click engaging said ratchet; and, (d) an energy reserving device coupled to said rotating mechanism for selectively actuating said rotation of said ratchet.

2. The variable billboard apparatus as recited in claim 1, wherein said energy reserving device includes a coil spring and a winding handle coupled thereto, said winding handle extending from said base seat for rotation.

3. The variable billboard apparatus as recited in claim 1 wherein said base seat includes first and second base boards, said first base board being disposed beneath said second base board, said first base board having at least a pair of pins projecting therefrom.

4. The variable billboard apparatus as recited in claim 3 wherein said intermittently rotating mechanism further includes:

(a) a slide board displaceably coupled to said first base board, said slide board having a central slot formed therein, said central slot slidably engaging said pins of said first base board, said slide board having opposing first and second side portions, said first side portion including a projection, said second side portion having an elliptic hole formed therein;

(b) a first extension spring extending between said first base board and said slide board for resiliently biasing said slide board to a home position relative to said first base board;

(c) a first rotary tray coupled to said first base board in angularly displaceable manner, said first rotary tray having a bottom face and a first rod projecting therefrom, said short rod engaging said first side portion projection for linearly displacing said slide board away from said home position responsive to angular displacement of said first rotary tray;

(d) a pivotally displaceable second rotary tray having a second rod projecting from a bottom face thereof to slidably engage said elliptic hole of said slide board, said second rotary tray pivotally supporting said click and said ratchet; and, (e) a second extension spring extending between said second rotary tray and said click for resiliently biasing said click to engage said ratchet;

whereby said second rotary tray is reciprocally displaced responsive to said slide board displacement.

5. The variable billboard apparatus as recited in claim 4 wherein said driving gear of said intermittently rotating mechanism is disposed on said second base board to drivingly engage an adjacent pair of said driven gears of said billboard assembly.

6. The variable billboard apparatus as recited in claim 5 wherein said intermittently rotating mechanism further includes a plurality of idle gears each engaging an adjacent pair of said billboard assembly driven gears, whereby said columns of said billboard assembly are collectively pivoted responsive to said driving gear rotation.

7. The variable billboard apparatus as recited in claim 6 wherein said second base board includes a bottom face having formed therein a plurality of recessed dents spaced in predetermined manner one from the other, each said dent corresponding to a pivotal configuration of said columns.

8. The variable billboard apparatus as recited in claim 7 wherein said intermittently rotating mechanism further includes a locating block coupled to at least one said idle gear, said locating block being rotatably disposed relative to said second base board bottom face and resiliently capturing thereagainst a rolling ball, said rolling ball engaging a selected one of said dents in releasably locked manner responsive to said idle gear rotation.

9. The variable billboard apparatus as recited in claim 8 wherein said dents are spaced in equidistant manner, adjacent ones of said dents being angularly spaced one from the other by approximately 120 degrees.

10. The variable billboard apparatus as recited in claim 4 wherein said first rotary tray is resiliently biased to a preset angular position relative to said first base board.

11. The variable billboard apparatus as recited in claim 1 further comprising a musical bell device driven by said energy reserving device.

* * * * *